US010971788B1

(12) United States Patent
Weale

(10) Patent No.: US 10,971,788 B1
(45) Date of Patent: Apr. 6, 2021

(54) METHOD OF FORMING A SEMICONDUCTOR DEVICE

(71) Applicant: SEMICONDUCTOR COMPONENTS INDUSTRIES, LLC, Phoenix, AZ (US)

(72) Inventor: Gareth Pryce Weale, New Hamburg (CA)

(73) Assignee: SEMICONDUCTOR COMPONENTS INDUSTRIES, LLC, Phoenix, AZ (US)

( * ) Notice: Subject to any disclaimer, the term of this patent is extended or adjusted under 35 U.S.C. 154(b) by 0 days.

(21) Appl. No.: 16/867,269

(22) Filed: May 5, 2020

(51) Int. Cl.
*H01P 1/18* (2006.01)
*H01P 9/00* (2006.01)
*H01P 11/00* (2006.01)

(52) U.S. Cl.
CPC ..... *H01P 1/181* (2013.01); *H01P 11/00* (2013.01)

(58) Field of Classification Search
CPC .. H01P 1/18; H01P 1/181; H01P 1/184; H01P 9/00; H01P 9/006
USPC ..... 333/139, 156, 161
See application file for complete search history.

(56) References Cited

U.S. PATENT DOCUMENTS 5,365,203 A * 11/1994 Nakamura ..... H01P 9/006 333/161
6,076,001 A * 6/2000 Das ..... H01P 1/181 333/161
6,498,549 B1 * 12/2002 Jiang ..... H01P 1/181 333/156
7,148,842 B1 12/2006 Crowne et al.
2003/0052750 A1 3/2003 Shamsaifar et al.
2007/0159271 A1 * 7/2007 Kuylenstierna ..... H01P 9/04 333/161
2013/0249653 A1 9/2013 Ferrari et al.

* cited by examiner

*Primary Examiner* — Dean O Takaoka
(74) *Attorney, Agent, or Firm* — Robert F. Hightower

(57) ABSTRACT

In an embodiment, a method of forming a delay line circuit may include forming a first ferro-electric material between a first conductor and a second conductor wherein the first conductor and the second conductor have a first resistivity. The first conductor may be configured to receive a d.c. bias signal. An embodiment may include forming a third conductor overlying the second conductor, the third conductor having a second resistivity that is less than the first resistivity, the third conductor connected to the second conductor at least at a plurality of points along a length of the third conductor. The third conductor may be configured to receive an RF signal and conduct the RF signal along the length of the third conductor.

20 Claims, 3 Drawing Sheets

METHOD OF FORMING A SEMICONDUCTOR DEVICE

BACKGROUND

The present invention relates, in general, to electronics, and more particularly, to circuits and methods of forming devices and circuits, semiconductors, semiconductor structures and circuits thereof, and semiconductor methods.

In the past, the electronics industry utilized various methods and structures to form delay lines for radio frequency (RF) signals. The delay line would receive the RF signal and delay it for a time interval to form a delayed RF signal. In some applications, it was desirable to have more than one delay line such as for example to form two or more different delays for a signal and send them to two or more different pieces of equipment. In some embodiments, it was difficult to combine more than one delay line on a circuit. Additionally, in some embodiments it was difficult to form an input impedance for the delay line that was suitable for the RF signal.

Some prior delay lines had discrete time intervals in which the RF signal could be delayed which often made it difficult to provide the desired delay time.

Accordingly, it is desirable to have a method or structure or circuit for a delay line that allows integrating more than one delay line on a circuit, or that can have a more desirable input impedance, or that can provide for a substantially continuous delay value.

Figure 1:
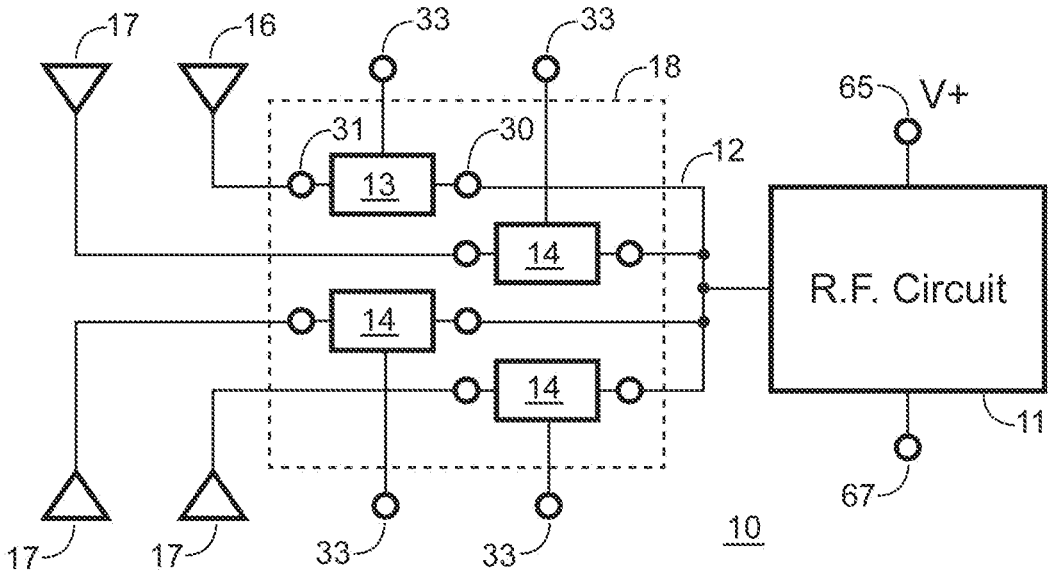
FIG. 1 schematically illustrates a block diagram of an example of a portion of an embodiment of an RF circuit or RF system in accordance with the present invention.

For simplicity and clarity of the illustration(s), elements in the figures are not necessarily to scale, some of the elements may be exaggerated for illustrative purposes, and the same reference numbers in different figures denote the same elements, unless stated otherwise. Additionally, descriptions and details of well-known steps and elements may be omitted for simplicity of the description. As used herein current carrying element or current carrying electrode means an element of a device that carries current through the device such as a source or a drain of a transistor such as an MOS transistor or a high electron mobility transistor (HEMI), or an emitter or a collector of a bipolar transistor, or a cathode or anode of a diode, and a control element or control electrode means an element of the device that controls current through the device such as a gate of an MOS transistor, a gate of a HEMT, or a base of a bipolar transistor. Additionally, one current carrying element may carry current in one direction through a device, such as carry current entering the device, and a second current carrying element may carry current in an opposite direction through the device, such as carry current leaving the device. Although the devices may be explained herein as certain N-channel or P-channel devices, or certain N-type or P-type doped regions, a person of ordinary skill in the art will appreciate that complementary devices are also possible in accordance with the present invention. One of ordinary skill in the art understands that the conductivity type refers to the mechanism through which conduction occurs such as through conduction of holes or electrons, therefore, that conductivity type does not refer to the doping concentration but the doping type, such as P-type or N-type. It will be appreciated by those skilled in the art that the words during, while, and when as used herein relating to circuit operation are not exact terms that mean an action takes place instantly upon an initiating action but that there may be some small but reasonable delay(s), such as various propagation delays, between the reaction that is initiated by the initial action. Additionally, the term while means that a certain action occurs at least within some portion of a duration of the initiating action. The use of the word approximately or substantially means that a value of an element has a parameter that is expected to be close to a stated value or position. However, as is well known in the art there are always minor variances that prevent the values or positions from being exactly as stated. It is well established in the art that variances of up to at least ten percent (10%) (and up to twenty percent (20%) for some elements including semiconductor doping concentrations) are reasonable variances from the ideal goal of exactly as described. When used in reference to a state of a signal, the term "asserted" means an active state of the signal and the term "negated" means an inactive state of the signal. The actual voltage value or logic state (such as a "1" or a "0") of the signal depends on whether positive or negative logic is used. Thus, asserted can be either a high voltage or a high logic or a low voltage or low logic depending on whether positive or negative logic is used and negated may be either a low voltage or low state or a high voltage or high logic depending on whether positive or negative logic is used. Herein, a positive logic convention is used, but those skilled in the art understand that a negative logic convention could also be used. The terms first, second, third and the like in the claims or/and in the Detailed Description of the Drawings, as used in a portion of a name of an element are used for distinguishing between similar elements and not necessarily for describing a sequence, either temporally, spatially, in ranking or in any other manner. It is to be understood that the terms so used are interchangeable under appropriate circumstances and that the embodiments described herein are capable of operation in other sequences than described or illustrated herein. Reference to "one embodiment" or "an embodiment" means that a particular feature, structure or characteristic described in connection with the embodiment is included in at least one embodiment of the present invention. Thus, appearances of the phrases "in one embodiment" or "in an embodiment" in various places throughout this specification are not necessarily all referring to the same embodiment, but in some cases it may. Furthermore, the particular features, structures or characteristics may be combined in any suitable manner, as would be apparent to one of ordinary skill in the art, in one or more embodiments. For clarity of the drawings, regions of device structures are illustrated as having generally straight line edges and precise angular corners. However, those skilled in the art understand that the edges generally may not be straight lines and the corners may not be precise angles.

The embodiments illustrated and described hereinafter may have embodiments and/or may be practiced in the absence of any element which is not specifically disclosed herein.

DETAILED DESCRIPTION

FIG. 1 schematically illustrates a block diagram of an example of a portion of an embodiment of an RF circuit or RF system 10 that may be an RF portion of a type of equipment such as for example a mobile telephone or other type of equipment. System 10 includes an RF circuit 11 that is used to form an RF signal 12 to drive an antenna 16 or alternately a plurality of antennas 16 and 17. Circuit 11 receives operating power for operating circuit 11 between a voltage input terminal 65 and a common return terminal 67. Terminal 67 is connected to a common return (CR) voltage such as a ground reference voltage or other common return for system 10. Terminal 65 receives an operating voltage (V+).

An embodiment of system 10 includes a tunable delay line circuit 13 or alternately a plurality of tunable delay line circuits 13 and 14 that may be used to delay RF signal 12 and adjust the propagation delay of the RF signal between circuit 11 and antenna 16 or alternately antennas 16 and 17. Circuit 13 includes an input 30 that is configured to receive signal 12 and also includes an output 31 that forms a delayed RF signal 15 that is a delayed version of signal 12. The amount of the delay is adjusted by a control signal received on a control terminal 33. An embodiment may include that circuits 13 and 14 are formed on a common substrate 18.

Figure 2:
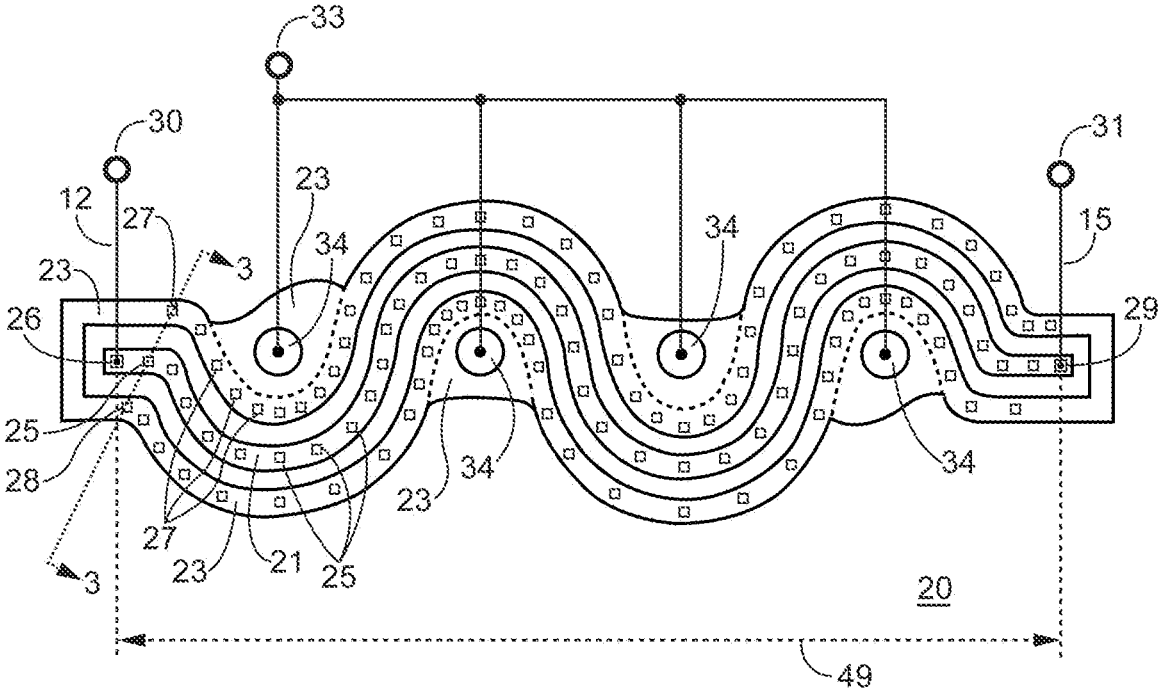
FIG. 2 illustrates an enlarged plan view of an example of a portion of an embodiment of an adjustable delay line circuit that may have an embodiment that may be an alternate embodiment of any one of the circuits of FIG. 1 in accordance with the present invention.

FIG. 2 illustrates an enlarged plan view of an example of a portion of an embodiment of an adjustable delay line circuit 20 that may have an embodiment that may be an alternate embodiment of any one of circuits 13 or 14 (FIG. 1). An embodiment of circuit 20 may be formed in a serpentine pattern between an input connection 26 and an output connection 29. Circuit 20 may be formed in a straight or linear pattern in other embodiments instead of the serpentine pattern. Connection 26 is electrically connected to input 30 and connection 29 is electrically connected to output terminal 31. In an embodiment, connections 26 and 29 may be bonding pads or other connecting pads to which input 30 and output 31, respectively, are connected. In an embodiment, connections 26 and 29 may be locations on a conductor 21 near the ends of conductor 21.

Figure 3:
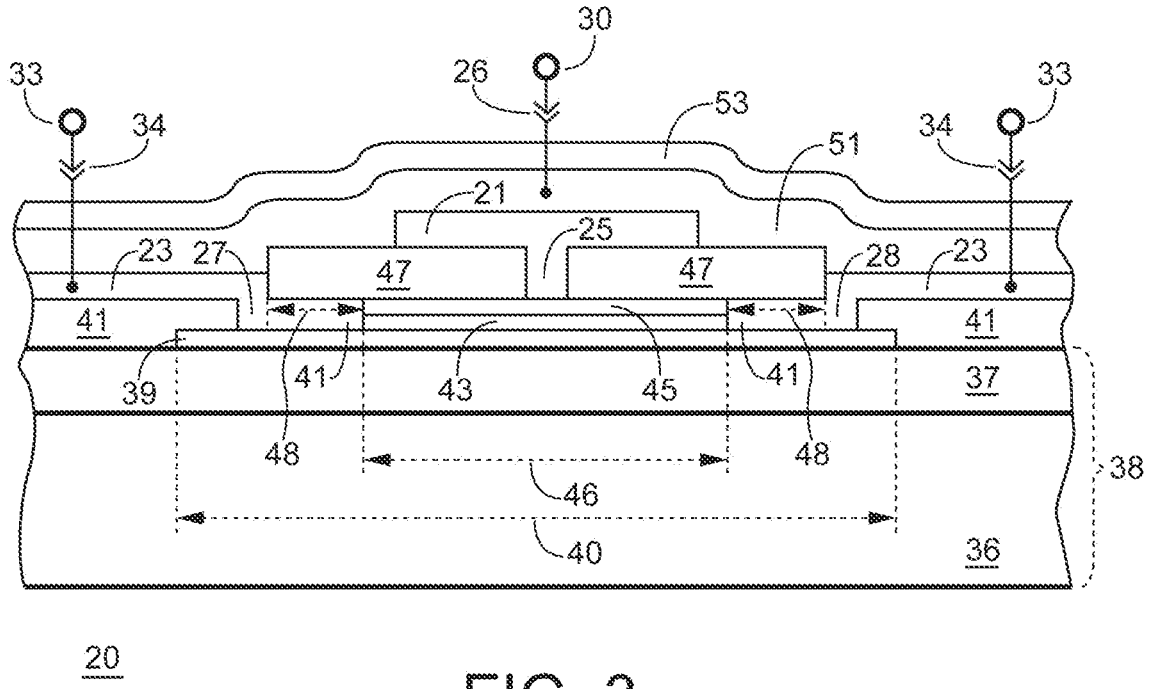
FIG. 3 illustrates an enlarged cross-sectional portion of an example of an embodiment of the circuit of FIG. 2 in accordance with the present invention.

FIG. 3 illustrates an enlarged cross-sectional portion of an example of an embodiment of circuit 20 along cross-section line 3-3 of FIG. 2. This description has references to FIG. 2 and FIG. 3.

Referring to FIG. 3, circuit 20 is formed on a substrate 38. An embodiment of substrate 38 may have an embodiment that is an alternate embodiment of substrate 18 (FIG. 1). In an embodiment, substrate 38 may include a bulk supporting substrate 36 that has an optional buffer layer 37 formed on a surface thereof. Substrate 36 may have an embodiment that may be ceramic or glass or sapphire, or a high resistance semiconductor substrate or other substrate material. An optional layer 37 may be formed on substrate 36 to reduce parasitic RF losses through substrate 36. Optional layer 37 may be a dielectric such as silicon dioxide or silicon nitride or titanium nitride or other magneto-dielectric materials.

Circuit 20 includes a tunable circuit 35 that is formed on substrate 38. An embodiment of circuit 35 includes a first conductor 39 that is formed on substrate 38, or alternately on another layer (not shown) overlying substrate 38. A ferroelectric material 43 is formed on conductor 39. A second conductor 45 is formed on material 43. In an embodiment, conductors 39 and 45 function as two plates of a capacitor and material 43 functions as the dielectric of the capacitor. In an embodiment, material 43 and conductor 45 both may have a width 46. An embodiment of conductor 39 may have a width 40 that is greater than width 46. Width 40 allows making contacts to conductor 39. An insulator 41 may be formed on substrate 38 adjacent to conductor 39. A portion of insulator 41 may overlap a portion of conductor 39 near an edge of conductor 39. For example, overlap a portion of conductor 39 near an edge that runs along a length of conductor 39.

An interconnect conductor 23 may be formed on insulator 41. Vias 27 and 28 may be formed through insulator 41 to make electrical contact to the outside edges of conductor 39. For example, vias 27 and 28 may be position overlying a portion of conductor 39 that does not underlie material 43 or alternately conductor 45. Vias 27 and 28 are formed as openings through insulator 41 that are filled with conductor material, for example the material of conductor 23. Vias 27 and 28 are spaced a distance 48 away from conductor 45 and material 43. Distance 48 affects the input impedance formed by circuit 20. Thus, distance 48 is selected to assist in forming a desired input impedance value for circuit 20. Conductor 23 may extend laterally away from conductor 45 such as extending overlying substrate 38. For example, extend substantially perpendicular to an axial line 49 (illustrated in a general manner by an arrow) that extends from connection 26 to connection 29 (FIG. 2). An insulator 47 may be formed on conductor 45 to prevent other electrodes from contacting conductor 45. An interconnect conductor 21 may be formed on insulator 47 and have a via 25 through insulator 47 to make an electrical connection to conductor 45. Via 25 is formed as an openings through insulator 47 that is filled with conductor material, for example the material of conductor 21. Those skilled in the art will appreciate that conductors 39, material 43, and conductor 45 extend in the serpentine pattern substantially perpendicular to the page of FIG. 3.

Those skilled in the art will appreciate that conductors 21, 23, 39, and 45, vias 25, 27, and 28, and insulators 41 and 47 may be formed by well known techniques such as evaporation, chemical vapor deposition, sputtering, screening, or other similar techniques.

Circuit 20 may have an embodiment that includes a hermetic layer 51 on the surface of circuit 20 in order to protect circuit 20 from environmental elements. Layer 51 may be a material such as silicon dioxide or silicon nitride or polyimide or other hermetic sealant materials. An embodiment of circuit 20 may also include an optional overcoat layer 53 on layer 51. Layer 53 may be an organic material such as polyimide or other type of coating material. Those skilled in the art will appreciate that layers 51 and 53 are not shown in FIG. 2 for clarity of the drawings.

In some embodiments, insulator 41 may be omitted and conductor 23 may be formed directly on conductor 39. For example, may be formed on substrate 38 and extend across substrate 38. An embodiment may include that insulator 47 may be omitted and conductor 21 may be formed directly on conductor 45.

Referring to FIG. 2, conductor 21, along with underlying conductor 45 and material 43, extend in the serpentine pattern along the length of circuit 20. Spaced along the length of conductor 21 (for example the equivalent length if it were in a straight line), a plurality of vias 25 are formed through insulator 47 to provide an electrical connection from conductor 21 to conductor 45. Conductor 23 also extends in the serpentine pattern along the length of circuit 20. However, conductor 23 is spaced apart laterally from conductor 45 and material 43. A portion of conductor 23, and vias 27-28, overlie a portion of conductor 39. In an embodiment, vias 27 and 28 are formed on opposite sides of conductor 21 to make an electrical connection between conductors 23 and 39. Additionally, connections 34 may be formed on conductor 23 in various places along the length of conductor 23. Connections 34 may be bonding pads or connection pads or merely portions of conductor 23 to which an electrical connection is made. For example, the width of conductor 23 may be increased at selected places along the length of conductor 23, and connections 34 may be formed in the widened regions. The electrical connections to connections 34 are inter-connected to terminal 33 which facilitates applying a control signal, such as for example a bias voltage, to conductor 39 through conductor 23 and vias 27-28.

Figure 4:
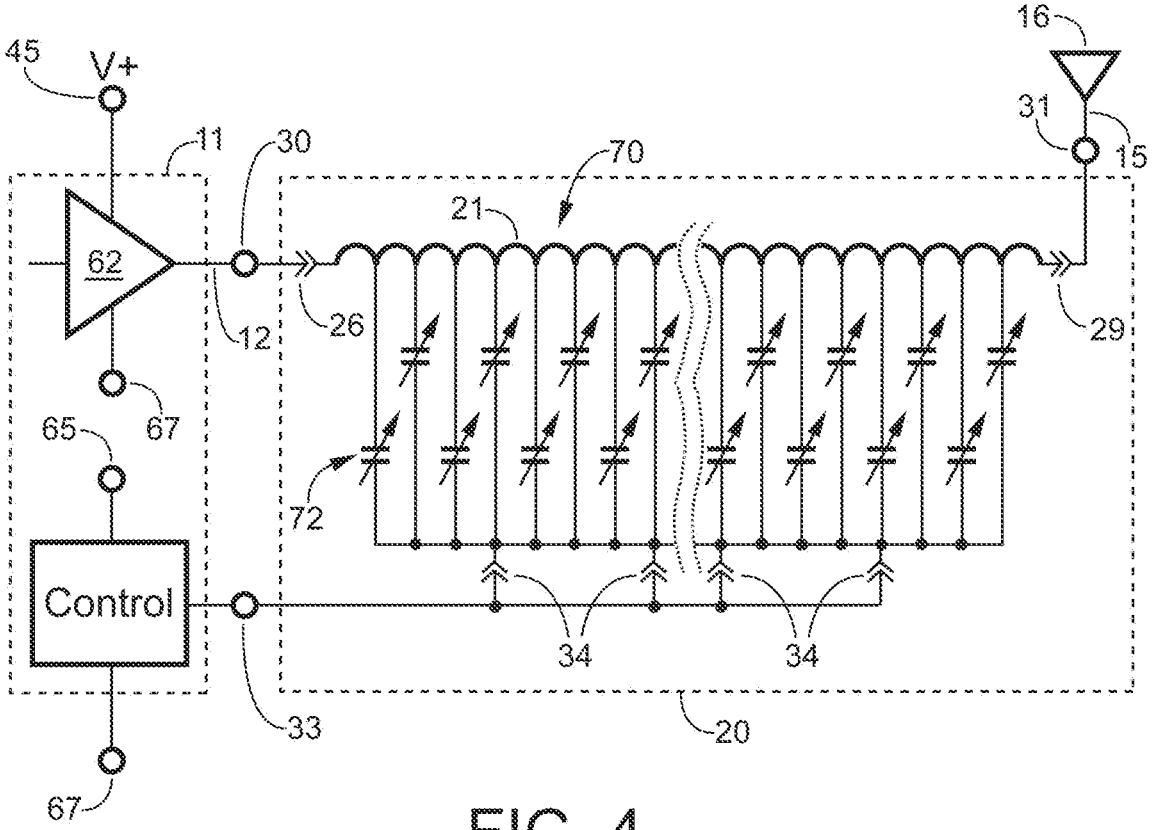
FIG. 4 schematically illustrates an example of a portion of an embodiment of a schematic representation of the circuit of FIG. 2 in accordance with the present invention.

FIG. 4 schematically illustrates an example of a portion of an embodiment of a schematic representation of circuit 20. The schematic has a break line that illustrates a discontinuity in the schematic for the purpose of illustrating aspects of the schematic, those skill in the art will appreciate that it does not represent an actual physical or electrical discontinuity in circuit 20. Conductor 21 has an inductance which is represented by an inductor 70. Conductors 39 and 45 along with material 43 form a distributed capacitance that is illustrated as capacitors 72. An embodiment may include that conductors 39 and 45 have a resistivity that is greater than a resistivity of conductor 21. In an embodiment, conductors 39 and 45 may be platinum conductors and material 43 may have an embodiment as a barium-strontium-titanite (BST) material. Conductor 21 may have an embodiment of a low resistance material such as aluminum, copper, aluminum-copper, gold, gold plated copper, etc. Thus, the resistivity of conductors 39 and 45 may be at least approximately five times (5X) to approximately ten times (10X) the resistivity of conductor 21.

Circuit 20 receives RF signal 12 on input 30. Signal 12 is conducted along conductor 21. Because conductor 45 has a high resistivity, thus high resistance, the RF signal is conducted along conductor 21. Thus, the low resistivity of conductor 21 may have an embodiment that facilitates forming a low resistance for inductor 70. The plurality of vias 25 assist in forming a plurality of connections between conductor 21 and conductor 45. Thus, vias 25 assist in forming a plurality of connections to the distributed capacitance of circuit 35 which is represented by capacitors 72. In an embodiment, vias 25 form a connection between capacitors 72 and conductor 21, thus to inductor 70 and signal 12.

Circuit 20 also receives the control signal, or alternately a d.c. bias voltage, on terminal 33. The control signal is applied to conductor 39 through conductor 23, or alternately through vias 27-28 and conductor 23. The control signal has a value that is referenced to the common mode voltage of signal 12. Thus, the control signal may have a value that is off-set from the common mode voltage of signal 12. An embodiment of the control signal can be greater than or less than or equal to the common mode voltage of signal 12. The control signal does not have a value of the common return (CR) voltage on terminal 67. Because material 43 is a ferro-electric material, the control signal can control the dielectric constant of material 43, thus, can control, or alternately set, the capacitance value of capacitors 72. The capacitance of capacitors 72 and the inductance of inductor 70 controls the delay formed by circuit 20. Thus, the control signal can set the delay time between signal 12 and signal 15. Because the control signal can vary in a linear manner the capacitance of capacitors 72, thus the delay time, can vary linearly in response to the value of the control signal. Thus, the delay time of circuit 20 is continuously variable.

Figure 5:
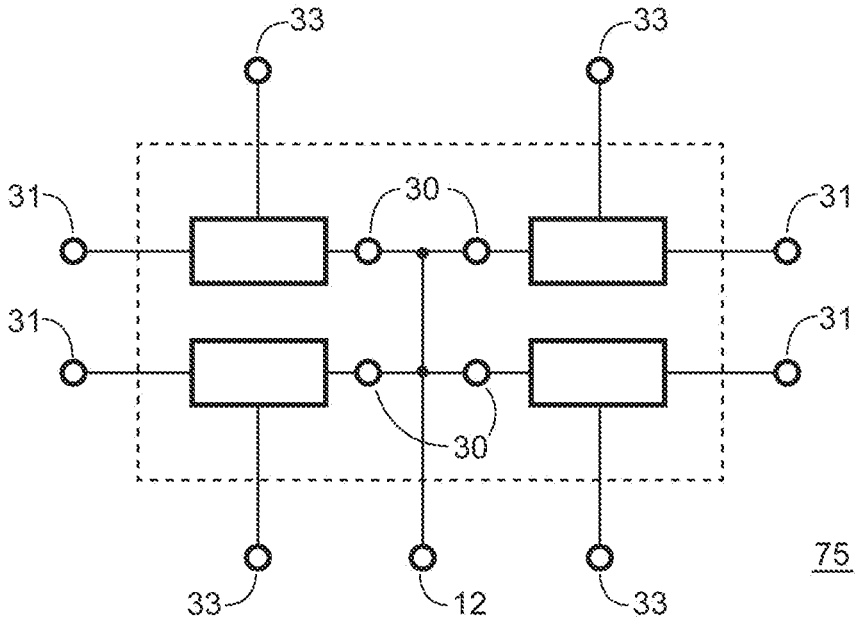
FIG. 5 schematically illustrates a block diagram of an example of a portion of an embodiment of a circuit that has a plurality of delay lines in accordance with the present invention.

FIG. 5 illustrates a plan view of an example of an embodiment of a block diagram of an adjustable delay line circuit 75 that may have an embodiment that may be an alternate embodiment of circuit 20. Circuit 75 includes substrate 38 on which a plurality of circuits 20 are formed. In an embodiment, each terminal 33 may receive a different value of the control signal in order to form the desired phase between each delayed R.F. signal. Alternately, one or more of circuits 20 may receive the same value of the control signal.

From all the foregoing, one skilled in the art will appreciate that an example of an embodiment of a delay line for an R.F. signal, the delay line may comprise:

a substrate, such as for example substrate 38, having a surface;

a first platinum conductor, such as for example conductor 39, on the substrate, the first platinum conductor having a first width, such as for example width 40, and a first length, the first platinum conductor configured to receive a d.c. bias voltage at a first plurality of points, such as for example one or more of points 27/28, along the first length wherein the d.c. bias voltage has a value that is greater than a ground reference value;

a barium-strontium-titanite material, such as for example material 43, on the first platinum conductor;

a second platinum conductor, such as for example conductor 45, on the barium-strontium-titanite material, the second platinum conductor having a second width, such as for example width 46, and a second length, such as for example length 49, the second platinum conductor spaced laterally a first distance, such as for example distance 48, from the first plurality of points;

a first insulator, such as for example insulator 47, on the second platinum conductor; and a conductor, such as for example conductor 21, on the first insulator and overlying the second platinum conductor, the conductor having a third length and electrically connected to the second platinum conductor at a second plurality of points, such as for example vias 25, formed through the first insulator and along the third length, the conductor configured to receive an R.F. signal, such as for example signal 12, wherein the R.F. signal propagates laterally through the conductor along the third length.

An embodiment of the delay line may include that the barium-strontium-titanite material may have substantially the second width and substantially the second length.

In an embodiment, the second plurality of points may be interconnect vias that are portions of the conductor extending from the conductor through the first insulator to the second platinum conductor.

An embodiment may include the first plurality of points are interconnect vias that may connect the first platinum conductor to an overlying metal layer, such as for example conductor 23, wherein the overlying metal layer is spaced a distance laterally from the second platinum conductor.

The delay line may have an embodiment wherein the second platinum conductor and the conductor extend in a linear shape overlying the substrate.

In an embodiment, the second platinum conductor and the conductor may extend in a serpentine shape overlying the substrate.

Another embodiment may include a second insulator, such as for example insulator 41, on the substrate wherein a portion of the second insulator is on the first platinum conductor.

An embodiment may include that the first plurality of points may be interconnect vias through the portion of the second insulator wherein the interconnect vias connect the first platinum conductor to an interconnect conductor, such as for example conductor 23.

The delay line may have an embodiment wherein the conductor forms an inductor of the delay line.

In an embodiment, the first platinum conductor, the barium-strontium-titanite material, and the second platinum conductor form a capacitor having a capacitance that is controlled by the d.c. bias voltage.

An embodiment may include that the capacitor forms a distributed capacitance along the third length.

Those skilled in the art will appreciate that an example of an embodiment of a method of forming an R.F. delay line circuit, may comprise:

forming a first ferro-electric material, such as for example material 43, between a first conductor, such as for example conductor 39, and a second conductor, such as for example conductor 45, wherein the first conductor and the second conductor have a first resistivity;

configuring the first conductor to receive a d.c. bias signal;

forming a third conductor, such as for example conductor 21, overlying the second conductor, the third conductor having a second resistivity that is less than the first resistivity, the third conductor connected to the second conductor at least at a plurality of points, such as for example vias 25, along a length of the third conductor; and configuring the third conductor to receive an RF signal and conduct the RF signal along the length of the third conductor.

The method may also have an embodiment that may include forming the first conductor on a substrate, such as for example substrate 38.

An embodiment of the method may include forming a fourth conductor on the substrate, and forming a second ferro-electric material between a fifth conductor and the fourth conductor wherein the fourth conductor and the fifth conductor have the first resistivity.

In an embodiment, the method may include forming the first resistivity to be approximately five times greater than the second resistivity.

The method may have an embodiment that may include forming an insulator, such as for example insulator 47, on the second conductor and forming the third conductor on the insulator.

An embodiment may also include forming the first plurality of points as vias through the insulator wherein a portion of the third conductor extends through the vias to contact the second conductor.

Those skilled in the art will appreciate that an example of an embodiment of a circuit for delaying an R.F. signal, may comprise:

a first conductor, such as for example conductor 21, configured to receive an R.F. signal, the first conductor having a first resistivity;

a second conductor, such as for example conductor 45, underlying the first conductor and electrically connected to the first conductor at a plurality of points, such as for example vias 25, along a length of the second conductor, the second conductor having a second resistivity that is greater than the first resistivity;

a ferro-electric material, such as for example material 43, having a first major plane adjacent to a major plane of the second conductor; and a third conductor, such as for example conductor 39, having a major plane adjacent to a second major plane of the ferro-electric material, the third conductor configured to receive a d.c. bias signal that controls a dielectric constant of the ferro-electric material.

The circuit may have an embodiment that may include an insulator, such as for example insulator 47, between the first conductor and the second conductor.

An embodiment may include that the ferro-electric material may be on the third conductor, and wherein the second conductor is on the ferro-electric material.

In view of all of the above, it is evident that a novel device and method is disclosed. Included, among other features, is forming a low resistance conductor overlying and electrically connected to a higher resistance conductor. The low resistance conductor conducts the RF signal and forms an inductor of the delay line. The connections to an underlying conductor and ferro-electric material forms connections to the distributed capacitance. Controlling the spacing between the upper conductor and the lower conductor facilitates controlling the input impedance. Using sputtering or screening or other CVD to form the conductors and ferro-electric materials allows forming multiple delay line circuits on one substrate which lowers the costs. Forming the inductor coupled to the distributed capacitance facilitates forming the delay as a continuously variable delay instead of steps of delay.

While the subject matter of the descriptions are described with specific preferred embodiments and example embodiments, the foregoing drawings and descriptions thereof depict only typical and non-limiting examples of embodiments of the subject matter and are not therefore to be considered to be limiting of its scope, it is evident that many alternatives and variations will be apparent to those skilled in the art.

As the claims hereinafter reflect, inventive aspects may lie in less than all features of a single foregoing disclosed embodiment. Thus, the hereinafter expressed claims are hereby expressly incorporated into this Detailed Description, with each claim standing on its own as a separate embodiment of an invention. Furthermore, while some embodiments described herein include some but not other features included in other embodiments, combinations of features of different embodiments are meant to be within the scope of the invention, and form different embodiments, as would be understood by those skilled in the art.

The invention claimed is:

1. A delay line for an R.F. signal, the delay line comprising:

a substrate having a surface;

a first platinum conductor on the substrate, the first platinum conductor having a first width and a first length, the first platinum conductor configured to receive a d.c. bias voltage at a first plurality of points along the first length wherein the d.c. bias voltage has a value that is greater than a ground reference value;

a barium-strontium-titanite material on the first platinum conductor;

a second platinum conductor on the barium-strontium-titanite material, the second platinum conductor having a second width and a second length, the second platinum conductor spaced laterally a first distance from the first plurality of points;

a first insulator on the second platinum conductor; and a conductor on the first insulator and overlying the second platinum conductor, the conductor having a third length and electrically connected to the second platinum conductor at a second plurality of points formed through the first insulator and along the third length, the conductor configured to receive an R.F. signal wherein the R.F. signal propagates laterally through the conductor along the third length.

2. The delay line of claim 1 wherein the barium-strontium-titanite material has substantially the second width and substantially the second length.

3. The delay line of claim 1 wherein the second plurality of points are interconnect vias that are portions of the conductor extending from the conductor through the first insulator to the second platinum conductor.

4. The delay line of claim 1 wherein the first plurality of points are interconnect vias that connect the first platinum conductor to an overlying metal layer wherein the overlying metal layer is spaced a distance laterally from the second platinum conductor.

5. The delay line of claim 1 wherein the second platinum conductor and the conductor extend in a linear shape overlying the substrate.

6. The delay line of claim 1 wherein the second platinum conductor and the conductor extend in a serpentine shape overlying the substrate.

7. The delay line of claim 1 further including a second insulator on the substrate wherein a portion of the second insulator is on the first platinum conductor.

8. The delay line of claim 7 wherein the first plurality of points are interconnect vias through the portion of the second insulator wherein the interconnect vias connect the first platinum conductor to an interconnect conductor.

9. The delay line of claim 1 wherein the conductor forms an inductor of the delay line.

10. The delay line of claim 9 wherein the first platinum conductor, the barium-strontium-titanite material, and the second platinum conductor form a capacitor having a capacitance that is controlled by the d.c. bias voltage.

11. The delay line of claim 10 wherein the capacitor forms a distributed capacitance along the third length.

12. A method of forming an R.F. delay line circuit, comprising:

forming a first ferro-electric material between a first conductor and a second conductor wherein the first conductor and the second conductor have a first resistivity;

configuring the first conductor to receive a d.c. bias signal;

forming a third conductor overlying the second conductor, the third conductor having a second resistivity that is less than the first resistivity, the third conductor connected to the second conductor at least at a plurality of points along a length of the third conductor; and configuring the third conductor to receive an RF signal and conduct the RF signal along the length of the third conductor.

13. The method of claim 12 further including forming the first conductor on a substrate.

14. The method of claim 13 further including forming a fourth conductor on the substrate, and forming a second ferro-electric material between a fifth conductor and the fourth conductor wherein the fourth conductor and the fifth conductor have the first resistivity.

15. The method of claim 12 including forming the first resistivity to be approximately five times greater than the second resistivity.

16. The method of claim 12 further including forming an insulator on the second conductor and forming the third conductor on the insulator.

17. The method of claim 16 further including forming the first plurality of points as vias through the insulator wherein a portion of the third conductor extends through the vias to contact the second conductor.

18. A circuit for delaying an R.F. signal, comprising:

a first conductor configured to receive an R.F. signal, the first conductor having a first resistivity;

a second conductor underlying the first conductor and electrically connected to the first conductor at a plurality of points along a length of the second conductor, the second conductor having a second resistivity that is greater than the first resistivity;

a ferro-electric material having a first major plane adjacent to a major plane of the second conductor; and a third conductor having a major plane adjacent to a second major plane of the ferro-electric material, the third conductor configured to receive a d.c. bias signal that controls a dielectric constant of the ferro-electric material.

19. The circuit of claim 18 further including an insulator between the first conductor and the second conductor.

20. The circuit of claim 18 wherein the ferro-electric material is on the third conductor, and wherein the second conductor is on the ferro-electric material.

* * * * *